US005868342A

United States Patent [19]

Moody et al.

[11] Patent Number: 5,868,342

[45] Date of Patent: Feb. 9, 1999

[54] APPARATUS FOR DISPENSING TOILET TISSUE FROM CORELESS ROLLS

[75] Inventors: John R. Moody; Jack A. Rizzuto; Robert H. Dimock, all of Antioch, Calif.

[73] Assignee: James River Corporation, Va.

[21] Appl. No.: 948,670

[22] Filed: Oct. 10, 1997

Related U.S. Application Data

[63] Continuation of Ser. No. 566,966, Dec. 4, 1995, abandoned.

[51] Int. Cl.[6] ..... B65H 19/00

[52] U.S. Cl. ..... 242/560; 242/594.3; 242/597.6; 242/598.6; 242/599; 242/599.4

[58] Field of Search ..... 242/560, 597.8, 242/597.5, 597.6, 594.3, 598.6, 599.4, 599.2, 599

[56] References Cited

U.S. PATENT DOCUMENTS

| | | |
|---|---|---|
| D. 184,678 | 3/1959 | Jones et al. . |
| 2,487,763 | 11/1949 | Patterson et al. . |
| 2,571,321 | 10/1951 | Wettley . |
| 2,632,606 | 3/1953 | Krueger . |
| 2,699,903 | 1/1955 | Montgomery . |
| 2,805,030 | 9/1957 | Wolters . |
| 2,889,121 | 6/1959 | Heinle . |
| 2,908,450 | 10/1959 | Stone et al. . |
| 2,908,451 | 10/1959 | Tucker et al. . |
| 2,944,749 | 7/1960 | Maier . |
| 3,010,670 | 11/1961 | Jones et al. . |
| 3,211,504 | 10/1965 | Bump . |
| 3,281,089 | 10/1966 | Krueger et al. . |
| 3,294,329 | 12/1966 | Tucker et al. . |
| 3,381,909 | 5/1968 | Tucker et al. . |
| 3,584,802 | 6/1971 | Sleber . |
| 3,620,465 | 11/1971 | Wyatt . |
| 3,622,096 | 11/1971 | Young . |
| 3,637,276 | 1/1972 | Bump . |
| 3,656,699 | 4/1972 | Schnyder et al. . |
| 3,908,926 | 9/1975 | Ochs et al. . |
| 4,025,004 | 5/1977 | Massey . |
| 4,373,682 | 2/1983 | Dickson . |
| 4,375,874 | 3/1983 | Leotta et al. . |
| 4,998,681 | 3/1991 | McNeill . |
| 5,265,816 | 11/1993 | Collins . |
| 5,370,339 | 12/1994 | Moody et al. . |
| 5,415,357 | 5/1995 | Smith, Jr. . |
| 5,495,997 | 3/1996 | Moody ..... 242/560 X |

*Primary Examiner*—Donald P. Walsh
*Assistant Examiner*—William A. Rivera
*Attorney, Agent, or Firm*—Burns, Doane, Swecker & Mathis, L.L.P.

[57] ABSTRACT

Apparatus for alternately dispensing toilet tissue from coreless rolls of toilet tissue includes a dispenser having a cover movable between two positions to alternately expose rolls of coreless toilet tissue within the dispenser. A partition having an opening is affixed to the cover and movable with the cover. A pair of coreless roll spindles are mounted within the dispenser in axial alignment with one another and with the partition opening. The partition opening alternately receives the coreless roll spindles when the cover moves between the two positions. The disclosed apparatus can be used to retrofit an existing dispenser normally employed to sequentially dispense toilet tissue from two adjacent rolls of toilet tissue having cores.

21 Claims, 3 Drawing Sheets

APPARATUS FOR DISPENSING TOILET TISSUE FROM CORELESS ROLLS

This application is a continuation of application Ser. No. 08/566,966, filed Dec. 4, 1995 now abandoned.

TECHNICAL FIELD

This invention relates to an apparatus for dispensing toilet tissue from coreless rolls of toilet tissue. More particularly, the invention can be employed to modify a multi-roll dispenser normally used to dispense tissue from rolls of toilet tissue having cores to dispense tissue from rolls not having center cores.

BACKGROUND ART

It is known in the prior art to retain two rolls of toilet tissue having cores in a dispenser cabinet, one of the rolls being available for use while the other is stored in the dispenser cabinet in reserve and made available for use only when the first is exhausted.

U.S. Pat. No. 3,010,670, issued Nov. 28, 1961, discloses one such arrangement wherein the dispenser comprises a base or back wall which carries a semi-cylindrical housing hinged to the base. The housing is provided with a single removable mandrel which carries two axially aligned toilet tissue rolls. One of the rolls, which is the reserve roll, is enclosed or covered by a slidable cover so that the roll is not accessible for use until the other roll is exhausted. The cover is axially slidable in the housing only when the roll in use is completely exhausted. The dispenser disclosed in U.S. Pat. No. 3,010,670 is not suitable for use with coreless rolls of tissue.

The following patents are also representative of the present state of the prior art in this field: U.S. Pat. No. 5,370,339, issued Dec. 6, 1994, U.S. Pat. No. 4,373,682, issued Feb. 15, 1983, U.S. Pat. No. 4,375,874, issued Mar. 8, 1983, U.S. Pat. No. 3,908,926, issued Sep. 30, 1975, U.S. Pat. No. 3,656,699, issued Apr. 18, 1972, U.S. Pat. No. 3,620,465, issued Nov. 16, 1971, U.S. Pat. No. 2,944,749, issued Jul. 12, 1960, U.S. Pat. No. 2,889,121, issued Jun. 2, 1959, U.S. Pat. No. 2,805,030, issued Sep. 3, 1957, U.S. Pat. No. 2,699,903, issued Jan. 18, 1955, U.S. Pat. No. 2,571,321, issued Oct. 16, 1951, U.S. Pat. No. 3,584,802, issued Jun. 15, 1971, U.S. Pat. No. 3,622,096, issued Nov. 23, 1971, U.S. Pat. No. 2,632,606, issued Mar. 24, 1953, U.S. Pat. No. 2,908,451, issued Oct. 13, 1959, U.S. Pat. No. 5,415,357, issued May 16, 1995, U.S. Pat. No. 2,908,450, issued Oct. 13, 1959, U.S. Pat. No. 3,281,089, issued Oct. 25, 1966, and U.S. Pat. No. Des. 184,678, issued Mar. 24, 1959.

DISCLOSURE OF INVENTION

The present invention relates to an apparatus which allows for the sequential dispensing of toilet tissue from coreless toilet tissue rolls maintained side-by-side within the confines of the apparatus. The principles of the invention are applicable to retrofit an existing dispenser of the type generally shown in the above-referenced U.S. Pat. No. 3,010,670 or incorporated in dispensers during manufacture thereof. The apparatus also encompasses unique coreless roll spindles which restrict free-wheeling of the coreless tissue roll when unwinding takes place.

The apparatus includes a dispenser having spaced end walls, mounting elements located at the end walls, a cover selectively movable between two positions for alternately selectively individually exposing rolls of toilet tissue mounted between said end walls, and a partition defining a partition opening.

The partition is affixed to the cover and movable with the cover when the cover moves between the two positions.

The apparatus also includes a pair of coreless roll spindles, each of the coreless roll spindles for supporting a coreless roll.

Spindle mounting means is employed for mounting the coreless roll spindles in substantial axially alignment on the mounting elements. The partition opening alternately receives the coreless roll spindles when the cover moves between the two positions.

The apparatus coreless roll spindles are for rotatably supporting coreless paper rolls. Each coreless roll spindle includes a spindle shaft having a base and a distal end spaced from the base.

A mounting member is attached to the spindle shaft at the base for mounting the spindle shaft at selected location.

At least one roll engagement element is rotatably mounted on the spindle shaft between the base and the distal end for positioning between the spindle shaft and a coreless paper roll. The at least one roll engagement element has an axis of rotation and outer peripheral surface, a portion of the outer peripheral surface being located further from the axis of rotation and from the shaft than the remainder of the outer peripheral surface.

The at least one roll engagement element is constructed of deformable, resilient material and urged into constrictive frictional engagement with the spindle shaft by a coreless paper roll to resist rotation of the coreless paper roll relative to the spindle shaft when a coreless paper roll surrounds and is in engagement with the at least one roll engagement element.

Other features, advantages, and objects of the present invention Will become apparent with reference to the following description and accompanying drawings.

BEST MODE FOR CARRYING OUT THE INVENTION

Figure 1:
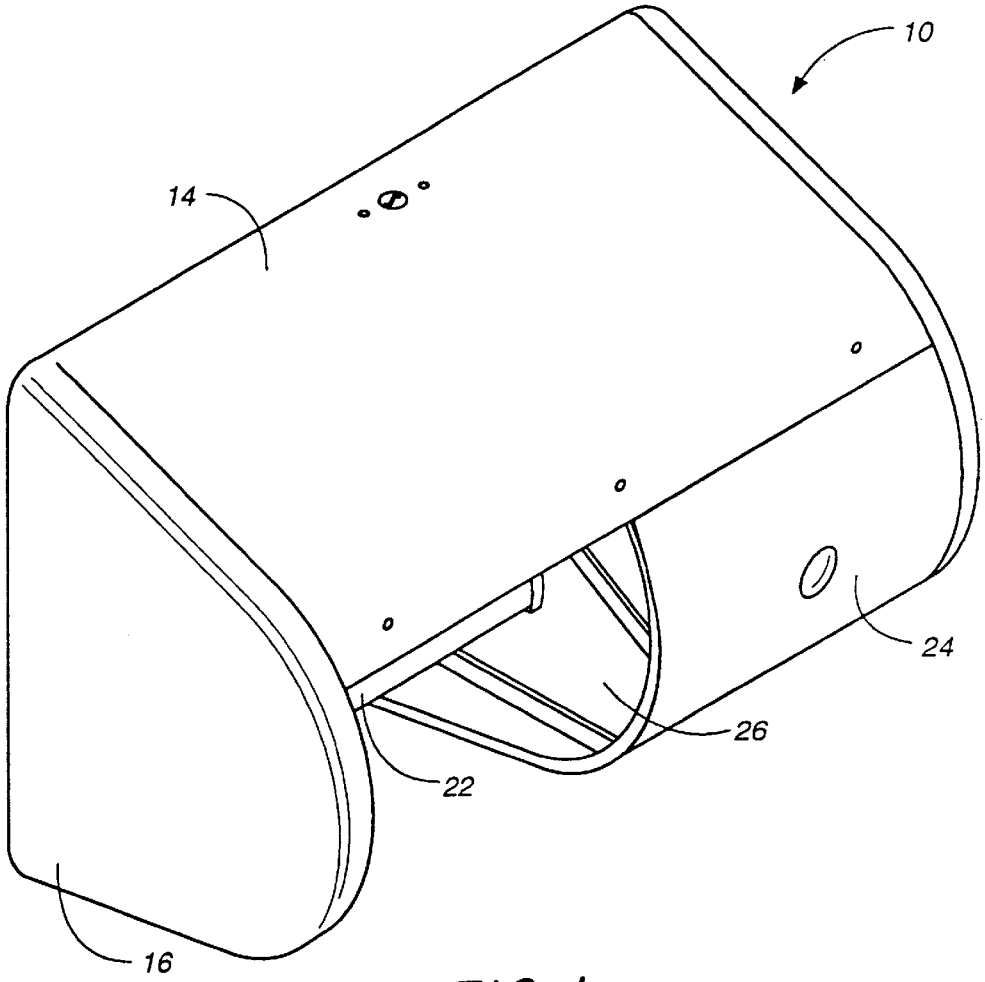
FIG. 1 is a perspective view of a prior art dispenser cabinet for use in sequentially dispensing toilet tissue from two rolls of toilet tissue having cores disposed side-by-side within the dispenser.
Figure 2:
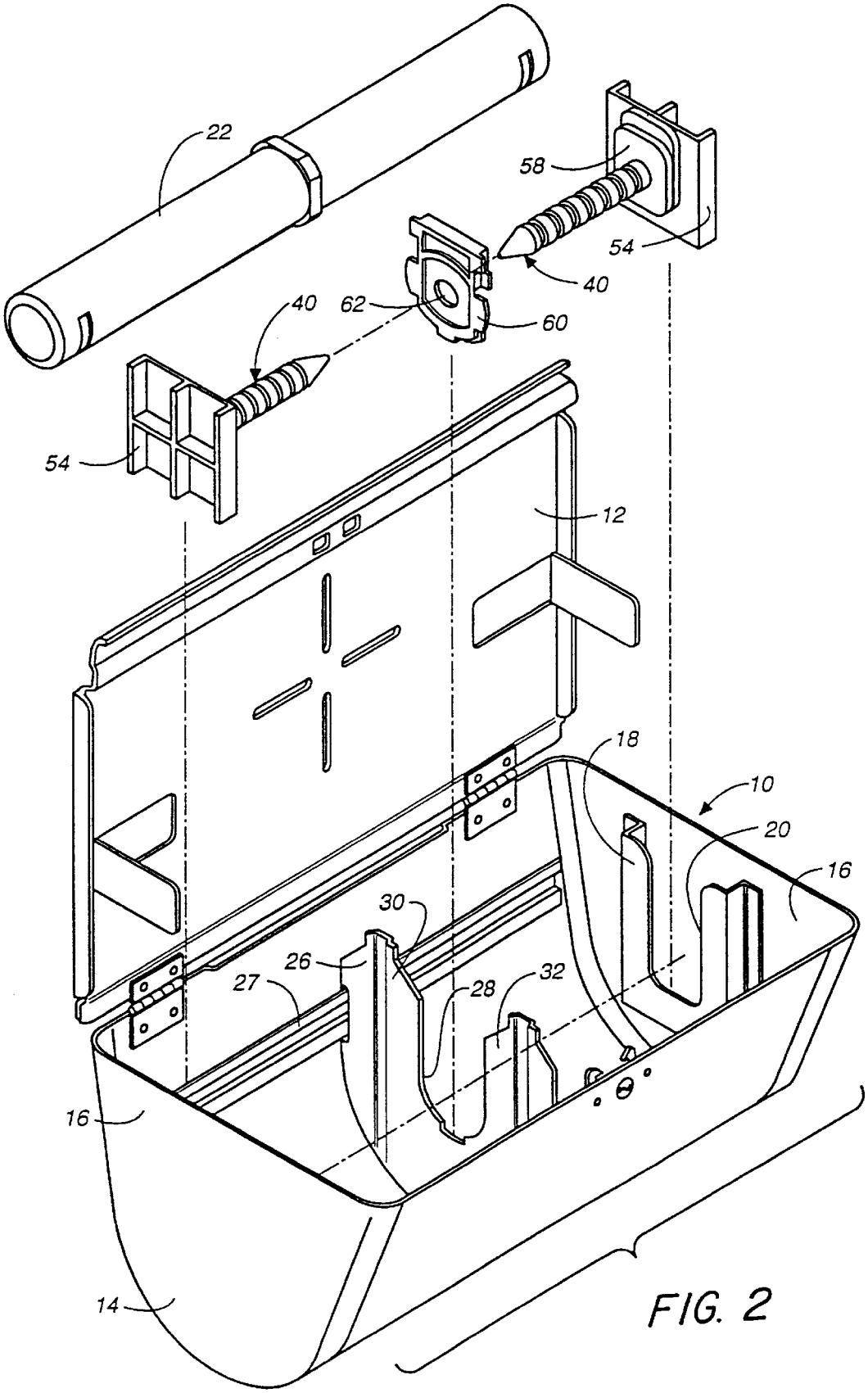
FIG. 2 is a perspective view of the dispenser cabinet of FIG. 1 with the cover thereof open to disclose the interior structure thereof and illustrating the elongated support mandrel normally employed therewith removed, two replacement coreless roll spindles for replacing the elongated support mandrel, and an insert for attachment to the partition of the dispenser cabinet.
Figure 3:
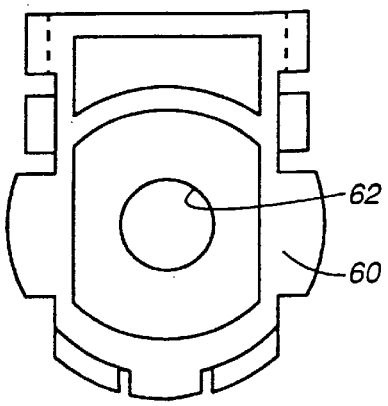
FIG. 3 is an enlarged, elevation view of the insert for attachment to the partition of the dispenser cabinet.
Figure 5:
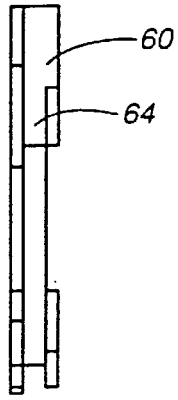
FIG. 5 is a side view of the insert.
Figure 4:
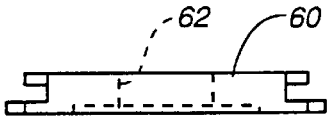
FIG. 4 is a top view of the insert.
Figure 8:
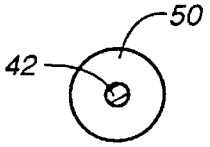
FIG. 8 is a cross-sectional view taken along the line 8—8 of FIG. 7.
Figure 9:
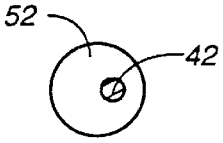
FIG. 9 is a cross-sectional view taken along the line 9—9 of FIG. 7.
Figure 6:
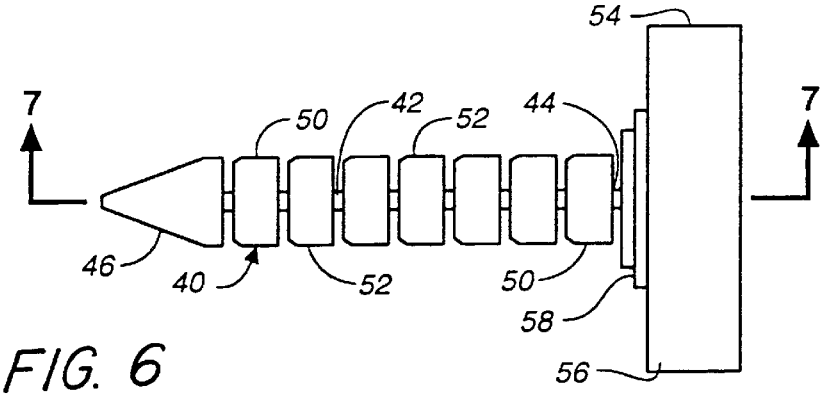
FIG. 6 is an elevation view of a coreless roll spindle of the present invention and the spindle mounting means operatively associated therewith.
Figure 7:
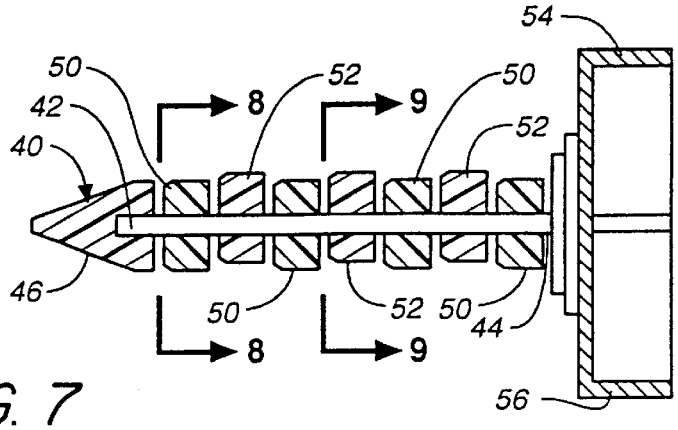
FIG. 7 is a cross-sectional view taken along the line 7—7 of FIG. 6.

FIGS. 1 and 2 illustrate a prior art dispenser device of the type disclosed in U.S. Pat. No. 3,010,670, referenced above.

The dispenser 10 is utilized to sequentially dispense toilet tissue from two adjacent conventional rolls of toilet tissue having cores. In the interest of simplicity, such rolls have not been shown; however, reference may be had to U.S. Pat. No. 3,010,670 for a depiction thereof.

The dispenser 10 includes a back mounting wall 12 for mounting the dispenser on a wall or other surface. Hinged to the back wall 12 is the dispenser body or housing 14. Suitable lock means is employed to selectively latch the housing 14 in closed position relative to the back wall as shown in FIG. 1.

Housing 14 has spaced end walls 16. Attached to the two end walls 16 within the interior of the housing are mounting elements 18, only one of the mounting elements being illustrated in FIG. 2. Each mounting element defines a recess 20 which receives an end of an elongated roll support or mandrel 22 which is utilized to support two adjacent rolls of toilet tissue having cores as further described in U.S. Pat. No. 3,010,670. FIG. 1 shows the mandrel mounted and FIG. 2 shows the mandrel removed from the mounting elements.

Dispenser 10 additionally includes a slidable cover 24 which is movable between two positions for alternately selectively individually exposing rolls of toilet tissue mounted on the elongated roll support 22 so that a consumer can manually dispense toilet tissue from the exposed roll. In FIG. 1 the cover 24 is shown being located at one position assumed thereby at the extreme right hand side of the housing as viewed from the dispenser front, it being understood that movement of the cover 24 to the left will expose the right hand roll.

A partition 26 is affixed to the cover 24 and moves therewith within the interior of the housing 14. A track 27 on the housing 14 opposite the cover is slidably engaged by the partition to stabilize the partition. The partition 26 defines a partition opening 28 for receiving the elongated support 22 when the elongated support is in place within the housing. The partition includes two partition portions 30, 32 disposed side-by-side, the partition opening being in the form of an open-ended slot defined by the partition portions.

The arrangement just described prevents movement of the slidable cover to expose a reserve roll having a core until the other roll having a core is exhausted, it being understood that the partition abuts against the end of the roll in use to prevent movement of the cover until exhaustion of the abutted roll. Again, U.S. Pat. No. 3,010,670 can be referred to for additional details.

The dispenser just described is not suitable for use with coreless rolls of toilet tissue. The mandrel 22 cannot be inserted into the coreless roll. In addition, the partition opening 28 is such that it will allow movement of the partition and cover before a coreless roll is depleted. Coreless rolls have very restricted central apertures much smaller in diameter than the diameter of cores found in conventional rolls of toilet tissue.

In order to retrofit dispenser 10 to allow the use of coreless toilet tissue rolls, elongated roll support or mandrel 22 is removed from the recesses 20 of mounting elements 18. The mandrel is replaced by two coreless roll spindles 40 of a specified character. See FIGS. 2 and 6–9. Each spindle 40 includes a spindle shaft 42 having a base 44 and a distal end 46. The distal end 46 comprises a tapered enlargement tapering in the direction away from the base.

Rotatably journaled on spindle shaft 42 between the base and distal end are a plurality of roll engagement elements 50 and 52. The roll engagement elements 50, 52 are generally toroidal or donut-shaped. Elements 50 are symmetric with respect to their axes of rotation about spindle shaft 42. On the other hand, elements 52 have offset centers of rotation; that is, with respect to each roll engagement element 52, a portion of the outer peripheral surface thereof is located further from the axis of rotation and from the shaft than the remainder of the outer peripheral surface. At least elements 52 are constructed of deformable, resilient material, such as plastic material.

The spindles are inserted tapered end first into the constricted central opening of a coreless roll of toilet tissue and then the spindle is manually pushed fully into the roll so that the roll is tightly disposed about the roll engagement elements 50, 52; that is, the elements are located between the roll and the spindle shaft. This will cause deformation of at least some of the roll engagement elements, in particular elements 52, to deform the elements and urge them into constrictive frictional engagement with the spindle shaft. This will prevent free wheeling of the coreless roll during unwinding thereof by a consumer.

Positioning of a coreless roll on the spindles will normally take place with the spindles removed from the housing 14 as shown in FIG. 2. The spindles are then positioned on the mounting elements 18. The shaft of each spindle is attached to a mounting member 54 including an enlarged segment 56 which is positioned between an end wall 16 and a mounting element 18 and a segment of reduced size 58 which is located in and projects from mounting element recess 20 to hold the spindle in place. The spindles will be axially aligned when both are seated in position relative to the housing 14.

As indicated above, the partition opening 28 in cabinets of the type shown in U.S. Pat. No. 3,010,670 is sized for use in conjunction with toilet tissue rolls having cores. It is necessary to reduce the effective size of this opening so that the cover 24 cannot be manually shifted prematurely when coreless toilet tissue rolls are employed.

This is accomplished by an insert 60 which defines an insert opening 62 smaller than the partition opening and slightly larger than the cross section of a spindle.

The insert 60 incorporates tabs on the sides thereof which are spaced apart to define recesses 64 at the sides of the insert which slidably receive partition portions 30, 32 to attach the insert to the partition, insert opening 62 being in alignment with the spindles when the inserted is fully seated. This will prevent movement of partition 26 and thus cover 24 until a coreless roll on a spindle is virtually completely depleted.

We claim:

1. In a dispenser employed to sequentially dispense toilet tissue from two adjacent rolls of toilet tissue having cores, said dispenser having spaced end walls, mounting elements located at said end walls, a cover selectively movable between two positions for alternately selectively individually exposing rolls of toilet tissue mounted between the mounting elements, and a partition defining a partition opening, said partition being affixed to said cover and movable with said cover when said cover moves between said two positions, the improvement comprising:

a coreless roll retrofit assembly for adapting said dispenser to dispense toilet tissue from two adjacent coreless rolls of toilet tissue;

said retrofit assembly including two coreless roll spindles and spindle mounting means for mounting said coreless roll spindles in substantial axial alignment on said mounting elements; and a removable insert adapter for attachment to said partition at said partition opening and defining an insert opening smaller than said partition opening, said insert opening passing alternately over said coreless roll spindles when said cover moves between said two positions, said insert opening being able to pass over said coreless roll spindles when no coreless roll of toilet tissue is mounted thereon and prevented from passing thereover when the coreless roll of toilet tissue is mounted thereon.

2. The apparatus according to claim 1 wherein each of said coreless roll spindles includes a spindle shaft having a base and a distal end spaced from said base.

3. The apparatus according to claim 2 wherein each of said coreless roll spindles additionally includes at least one roll engagement element between said distal end and said base rotatable about said spindle shaft for engaging an innermost convolution of the coreless toilet tissue roll mounted on the coreless roll spindle.

4. The apparatus according to claim 3 wherein each of said coreless roll spindles includes a plurality of roll engagement elements rotatable independently about said spindle shaft.

5. The apparatus according to claim 3 wherein said at least one roll engagement element is urged into constrictive frictional engagement with said spindle shaft to resist rotation of the coreless roll of toilet tissue relative to said spindle shaft when the coreless roll of toilet tissue surrounds and is in engagement with said at least one roll engagement element.

6. The apparatus according to claim 3 wherein said at least one roll engagement element is generally toroidal shaped and has an offset center of rotation.

7. The apparatus according to claim 1 wherein said partition includes two partition portions disposed side by side and wherein said partition opening comprises an open-ended slot defined by said partition portions, said insert adapter including recesses for slidably receiving and engaging said partition portions to thereby attach said insert adapter to said partition.

8. The apparatus according to claim 1 wherein said mounting elements define recesses, said spindle mounting means being positioned in said recesses.

9. Apparatus for dispensing toilet tissue from a coreless roll of toilet tissue comprising:

a dispenser having spaced end walls, mounting elements located at said end walls, a cover selectively movable between two positions for alternately selectively individually exposing rolls of toilet tissue mounted between said end walls, and a partition defining a partition opening, said partition being affixed to said cover and movable with said cover when said cover moves between said two positions;

a pair of coreless roll spindles, each of the coreless roll spindles for supporting a coreless roll, each of said spindles including a first end and a second end; and spindle mounting means mounting said coreless roll spindles in substantial axial alignment on said mounting elements, said first end of each of said coreless roll spindles being rigidly cantilevered from said mounting elements such that said second end of each said spindle is disposed immediately adjacent to said partition opening; and said partition opening being dimensioned to alternately pass over said coreless roll spindles when said cover moves between said two positions, said partition opening being able to pass over said coreless roll spindles when no coreless roll of toilet tissue is mounted thereon and prevented from passing thereover when the coreless roll of toilet tissue is mounted thereon.

10. The apparatus according to claim 9 wherein each of said coreless roll spindles includes a spindle shaft having a base and a distal end spaced from said base.

11. The apparatus according to claim 10 wherein each of said coreless roll spindles additionally includes at least one roll engagement element between said distal end and said base rotatable about said spindle shaft for engaging the innermost convolution of a coreless toilet tissue roll mounted on the coreless roll spindle.

12. The apparatus according to claim 11 wherein each of said coreless roll spindles includes a plurality of roll engagement elements independently rotatable about said spindle shaft.

13. The apparatus according to claim 11 wherein said at least one roll engagement element is urged into constructive frictional engagement with said spindle shaft to resist rotation of a coreless roll of toilet tissue relative to said spindle shaft when the coreless roll of toilet tissue surrounds and is in engagement with said at least one roll engagement element.

14. The apparatus according to claim 11 wherein said at least one roll engagement element is generally toroidal shaped and has an offset center of rotation.

15. The apparatus according to claim 9 wherein said partition includes two partition portions disposed side by side and wherein said partition opening comprises an open-ended slot defined by said partition portions.

16. The apparatus according to claim 9 wherein said mounting elements define recesses, said spindle mounting means positioned in said recesses.

17. A coreless roll spindle for rotatably supporting a coreless paper roll, said coreless roll spindle comprising:

a spindle shaft having a base and a distal end spaced from said base;

a mounting member attached to said spindle shaft at said base for mounting said spindle shaft at a selected location;

at least one roll engagement element rotatably mounted on said spindle shaft between said base and said distal end for positioning between said spindle shaft and a coreless paper roll, said at least one roll engagement element having a shaft opening and an axis of rotation about said shaft opening, said axis of rotation being offset from a center of said roll engagement element, and said at least one roll engagement element being constructed of resilient material and urged into constrictive frictional engagement with said spindle shaft by the coreless paper roll such that the coreless paper roll resists rotation relative to said spindle shaft when it surrounds and is in engagement with said at least one roll engagement element.

18. The coreless roll spindle according to claim 17 wherein a plurality of roll engagement elements are independently rotatably mounted on said spindle shaft.

19. The coreless roll spindle according to claim 18 wherein said spindle shaft distal end comprises a tapered enlargement tapering in the direction away from said base.

20. The coreless roll spindle according to claim 18 wherein some of said roll engagement elements are offset relative to other of said roll engagement elements on said spindle shaft.

21. Apparatus for dispensing tissue from a coreless roll comprising:

a dispenser having spaced end walls; and at least one coreless roll spindle mounted in said dispenser for supporting a coreless roll of tissue, said spindle including a first end and a second end;

wherein said coreless roll spindle includes a spindle shaft, having a base and a distal end spaced from said base, and at least one roll engagement element disposed between said distal end and said base, said roll engagement element being rotatable independently about said spindle shaft for engaging in innermost convolution of the coreless tissue mounted on the coreless roll spindle, said roll engagement element being urged into constrictive frictional engagement with said spindle shaft such that rotation of the coreless roll of tissue relative to said spindle shaft is substantially prevented when the coreless roll of tissue surrounds and is in engagement with said roll engagement element.

* * * * *